US008545375B2

(12) United States Patent
Marco et al.

(10) Patent No.: US 8,545,375 B2
(45) Date of Patent: Oct. 1, 2013

(54) TOP LIFT CARRIER AND METHOD OF MANUFACTURE THEREFOR

(75) Inventors: Leslie S. Marco, Bloomingdale, IL (US); Arthur R. Slaters, Arlington Heights, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 1223 days.

(21) Appl. No.: 10/681,524

(22) Filed: Oct. 8, 2003

(65) Prior Publication Data

US 2005/0077194 A1 Apr. 14, 2005

(51) Int. Cl.
*B31B 1/86* (2006.01)

(52) U.S. Cl.
USPC ..... 493/226; 493/227

(58) Field of Classification Search
USPC ..... 493/226, 227, 221
See application file for complete search history.

(56) References Cited

U.S. PATENT DOCUMENTS

| | | | | | |
|---|---|---|---|---|---|
| 2,701,661 | A | * | 2/1955 | Murray | 206/154 |
| 3,608,949 | A | * | 9/1971 | Owen | 294/87.2 |
| 3,700,276 | A | * | 10/1972 | Klygis | 294/87.2 |
| 3,744,704 | A | * | 7/1973 | Struble | 206/194 |
| 4,269,308 | A | | 5/1981 | Platt | 206/150 |
| 4,324,328 | A | * | 4/1982 | Champlin | 206/194 |
| 4,850,479 | A | | 7/1989 | Bird | 206/150 |
| 5,018,620 | A | * | 5/1991 | Marco et al. | 206/150 |
| 5,038,928 | A | * | 8/1991 | Marco et al. | 206/162 |
| 5,097,650 | A | * | 3/1992 | Olsen | 53/398 |
| 5,261,530 | A | | 11/1993 | Marco | 206/150 |
| 5,437,364 | A | | 8/1995 | Broskow | 206/150 |
| 5,487,465 | A | | 1/1996 | Broskow | 206/150 |
| 5,593,026 | A | | 1/1997 | Broskow | 206/150 |
| 5,642,808 | A | * | 7/1997 | Marco et al. | 206/150 |
| 5,653,334 | A | * | 8/1997 | Marco | 206/150 |
| 5,655,654 | A | | 8/1997 | Broskow | 206/150 |
| 5,657,863 | A | | 8/1997 | Olsen | 206/150 |
| 5,746,310 | A | | 5/1998 | Slomski | 206/150 |
| 5,788,301 | A | | 8/1998 | Slomski | 294/87.2 |
| 5,806,667 | A | | 9/1998 | Marco | 206/150 |
| 5,868,659 | A | | 2/1999 | Slomski | 493/374 |
| 6,032,791 | A | * | 3/2000 | Gresh et al. | 206/150 |
| 6,152,508 | A | | 11/2000 | Slomski | 294/87.2 |
| 6,182,821 | B1 | | 2/2001 | Olsen | 206/150 |
| 6,415,917 | B1 | * | 7/2002 | Marco | 206/147 |
| 6,923,314 | B2 | * | 8/2005 | Marco | 206/143 |

FOREIGN PATENT DOCUMENTS

| | | | |
|---|---|---|---|
| EP | 0 242 108 | A2 | 10/1987 |
| EP | 0 318 618 | B1 | 9/1992 |
| EP | 0 507 479 | A1 | 10/1992 |
| EP | 0 748 744 | A1 | 12/1996 |
| EP | 0 782 962 | A1 | 7/1997 |
| EP | 0 842 864 | A1 | 5/1998 |
| EP | 0 842 865 | A1 | 5/1998 |
| EP | 0 846 630 | A1 | 6/1998 |
| EP | 0 678 456 | B1 | 7/1998 |
| EP | 0 792 819 | B1 | 4/1999 |
| EP | 1 004 518 | A2 | 5/2000 |
| EP | 1 077 183 | A1 | 2/2001 |
| EP | 1 174 361 | A2 | 1/2002 |

* cited by examiner

*Primary Examiner* — Sameh H. Tawfik
(74) *Attorney, Agent, or Firm* — Taylor IP, P.C.

(57) ABSTRACT

A carrier and a method for making a carrier with handles between rows of containers in both two-wide and three-wide configurations, and with the handle portion and container holding portion formed from different sheets connected together.

13 Claims, 4 Drawing Sheets

TOP LIFT CARRIER AND METHOD OF MANUFACTURE THEREFOR

FIELD OF THE INVENTION

The present invention relates to packaging arrangements for groups of containers such as bottles or cans, and, more specifically, the invention pertains to plastic carriers having arrays of loops for engaging and holding individual containers, particularly for large groups of containers.

BACKGROUND OF THE INVENTION

Container carriers are used frequently to unitize a plurality of containers, such as bottles or cans, into conveniently saleable quantities. Both paperboard and plastic are materials commonly used. Paperboard carriers generally comprise a box in which the containers are held. The box may be totally enclosed, or may have an open top, with individual compartments for each container. Disadvantages of paperboard carriers include excess material and cost. Further, once opened, an enclosed box no longer holds the containers securely. An open top carrier can spill the contents therein, if inverted.

Plastic carriers have achieved wide acceptance for their performance, low weight, low cost and versatility in being adapted for containers of different sizes and shapes. The general design for plastic carriers includes apertures in a stretchable plastic material. The apertures are sized and shaped to stretch around the periphery of the containers to be held, either bottles or cans.

For convenient carrying of a group of containers held by the carrier, various types of hand-grasps are known. For example, it is known to provide holes for fingertip grasping of the package. It is also known to provide a handle on the carrier, either along one side of the group of containers, or at the tops of the containers. Automated machinery is available for attaching stretchable plastic carriers to containers quickly and efficiently.

In one such known design, the carrier is formed from two webs of plastic material positioned over one another. Handle portions and container engaging portions are stamped from the positioned webs simultaneously. The webs are fused or welded along selected portions, such as by lamination. The resulting handle portion is thereby a double thickness of material, and the container engaging portions freely depend therefrom. The container engaging portions are a single ply of material. An interconnecting, truss-like suspension portion interconnects the handle portion with the container holding portion. The individual arrays of container holding loops extend freely from the suspension portion.

A trend in the beverage industry is to group larger quantities of containers for sale. While plastic carriers, as described above, have been used for so-called twelve-packs, known carriers for twelve packs commonly have been of the side handle variety. That is, with the containers secured in the carrier, and arranged in an upright position, the carrier handle is provided along one side of the group of containers. In a carrying position, the containers are positioned horizontally, at right angles to the upright position. For some consumers, carrying beverage containers horizontally is uncomfortable, because of fear, largely groundless, that a container seal may rupture, spilling all or a substantial quantity of the beverage.

In an upright carry position, the look and feel of the package is more natural. However, hereto fore it has been difficult to provide handles of sufficient strength and reliable feel for carrying twelve packs in an upright position. Further, it is desirable that known application equipment be used for applying the carriers to the containers.

Problems have been encountered when applying some previous carriers to containers. When carrier loops are provided in two different superimposed sheets, the distance between outermost carrier loops on opposite sides is determined by the location of welds between the sheets. If the weld location varies the distance between the loops also varies, and stretchability of the carrier can be effected. When loops and handle portions are provided in the same sheet, it is difficult to move the handle portions without distorting the loops. These factors can present problems for automatic application equipment that attaches the carrier to a group of containers.

What is needed in the art is a top lift carrier and a method for its manufacture that works equally well for two row wide and three row wide configurations.

SUMMARY OF THE INVENTION

The present invention provides a carrier and a method for making a carrier with handles between rows of containers in both two-wide and three-wide configurations, and with the handle portion and container holding portion formed from different sheets connected together.

In one form thereof, the present invention provides a method of making a container carrier with steps of providing a handle sheet and a carrier sheet; positioning the handle sheet on at least a portion of the carrier sheet; connecting the handle sheet and the carrier sheet along a line of attachment; forming first and second rows of container receiving apertures in the carrier sheet on opposite sides of the line of attachment; and forming holes in the handle sheet simultaneously with forming the first row of apertures, the holes and the first row of apertures formed in substantially the same configurations.

In another form thereof, the present invention provides a method of making a container carrier with steps of providing a handle sheet and a carrier sheet; positioning the handle sheet against the carrier sheet; connecting the handle sheet and the carrier sheet along spaced first and second lines of attachment; removing a strip of the handle sheet between the lines of attachment, leaving a first handle portion outwardly from the first line of attachment and a second handle portion outwardly from the second line of attachment; forming a first row of container receiving apertures in the carrier sheet outwardly from the first line of attachment and simultaneously forming holes in the first handle portion similarly shaped to the first row of apertures; forming a second row of apertures in the carrier sheet between the first and second lines of attachment; and forming a third row of container receiving apertures in the carrier sheet outwardly from the second line of attachment and simultaneously forming holes in the second handle portion similarly shaped to the third row of apertures.

In a further form thereof, the present invention provides a container carrier with a carrier sheet having first and second elongated side edges and first and second ends. First and second rows of apertures in the carrier sheet are configured for holding individual containers, the apertures in each row being substantially aligned with each other between the first and second ends. A first handle portion is secured to the carrier sheet along a line of attachment between the first and second rows of apertures. The first handle portion includes a suspension portion and a handle, the suspension portion including holes therein substantially the same as the apertures of the first row.

An advantage of the present invention is providing a lightweight and inexpensive top lift carrier for large packages of containers, including twelve-packs of bottles, cans and the like.

Another advantage of the present invention is providing a carrier for containers such a bottles, cans or the like having a two handle portions and a container holding portion, with the handle portion evenly balanced with respect to a large group of containers held by the carrier.

Yet another advantage of the present invention is providing a plastic carrier for twelve-packs of containers such a bottles, cans and the like which can be manufactured easily and quickly using known manufacturing techniques, and which can be applied on the containers with known applicating equipment.

A further advantage of the present invention is providing an inexpensive plastic carrier for containers such as bottles, cans and the like that conveys a firm and secure feel of the package to a person carrying the package suspended from a handle of the carrier.

A still further advantage of the present invention is providing a carrier for containers, in which separate handle sheets and carrier sheets are used, which can be of different materials or thickness as necessary or advantageous for the final package.

An even further advantage of the present invention is that all container carrying loops are provided in a single sheet, and the spacing between loops is determined by the die cutting the loops, providing increased consistency in location when compared to designs in which weld locations determine spacing.

Still another advantage of the present invention is that with all container carrying loops in a single sheet, and the handle formed in a separate sheet, the handle can be moved out of the way for attaching the loops to containers, without distorting the loops and complicating the application process.

Other features and advantages of the invention will become apparent to those skilled in the art upon review of the following detailed description, claims and drawings in which like numerals are used to designate like features.

Figure 1:
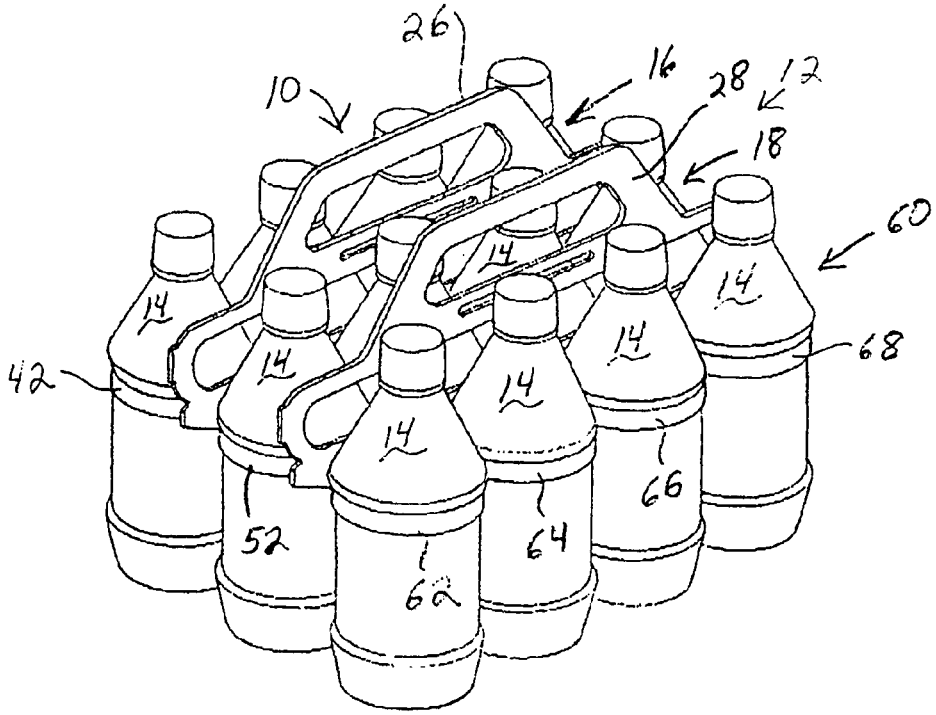
FIG. 1 is a perspective view of a package of bottles secured by a container carrier in accordance with the present invention.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including", "comprising" and variations thereof is meant to encompass the items listed thereafter and equivalents thereof, as well as additional items and equivalents thereof.

DETAILED DESCRIPTION OF THE PREFERRED EMBODIMENT

Referring now more specifically to the drawings and to FIG. 1 thereof in particular, numeral 10 designates a container carrier in accordance with the present invention. Carrier 10 is used to assemble a package 12 consisting of a plurality of containers 14. In the exemplary embodiment shown in FIG. 1, package 10 is provided for a so-called twelve-pack, and is shown for packaging twelve individual containers 14 in the form of bottles 14. However, it should be understood that the present invention can be used advantageously for packaging more or fewer containers 14 than the twelve-pack shown. Further, while package 12 is illustrated for packaging individual containers 14 in the form of bottles, package 10 can be used for packaging containers 14 other than bottles. For example, package 10 can be used also for packaging cans, and also can be used for packaging bottles of different shapes.

Carrier 10 includes a first handle portion 16 and a second handle portion 18 joined to a container holding portion 20 along respective first and second lines of attachment 22 and 24, commonly referred to as "welds". Those skilled in the art will understand readily that welds 22 and 24 can be formed in a variety of ways. A known way of forming welds 22 and 24 is by extruding a bead of material similar to the material of carrier 10 between container holding portion 20 and first and second handle portions 16 and 18.

First and second handle portions 16 and 18 include first and second handles 26 and 28, respectively, that define graspable portions of carrier 10 by which package 12 can grabbed, lifted and carried. First and second suspension portions 30 and 32, respectively, interconnect first and second handles 26 and 28 with container holding portion 20.

Carrier 10, and particularly container holding portion 20 thereof, is made of flexible, resilient material that can be stretched significantly without breaking. Low-density polyethylene is a suitable plastic from which carrier 10 can be made. Container holding portion 20 is configured to secure individually each container 14. Thus, container holding portion 20 has a first row 40 of container holding apertures formed by loops 42, 44, 46 and 48, each adapted to hold a container 14 therein. First row 40 is formed outwardly of first weld 22. Container holding portion 20 further includes a second row 50 of container holding apertures formed by loops 52, 54, 56 and 58, each adapted to hold a container 14 therein. Second row 50 is formed between welds 22 and 24. Container holding portion 20 also includes a third row 60 of container holding apertures formed by loops 62, 64, 66 and 68, each adapted to hold a container 14 therein. Third row 60 is formed outwardly of second weld 24.

Welds 22 and 24 can be continuous bonds from one end 70 of carrier 10 to an opposite end 72 of carriers 10. Alternatively, depending on the configuration required for container holding portion 20 allowing it to receive containers therein, welds 22 and 24 can be formed as a series of discrete segments.

Figure 4:
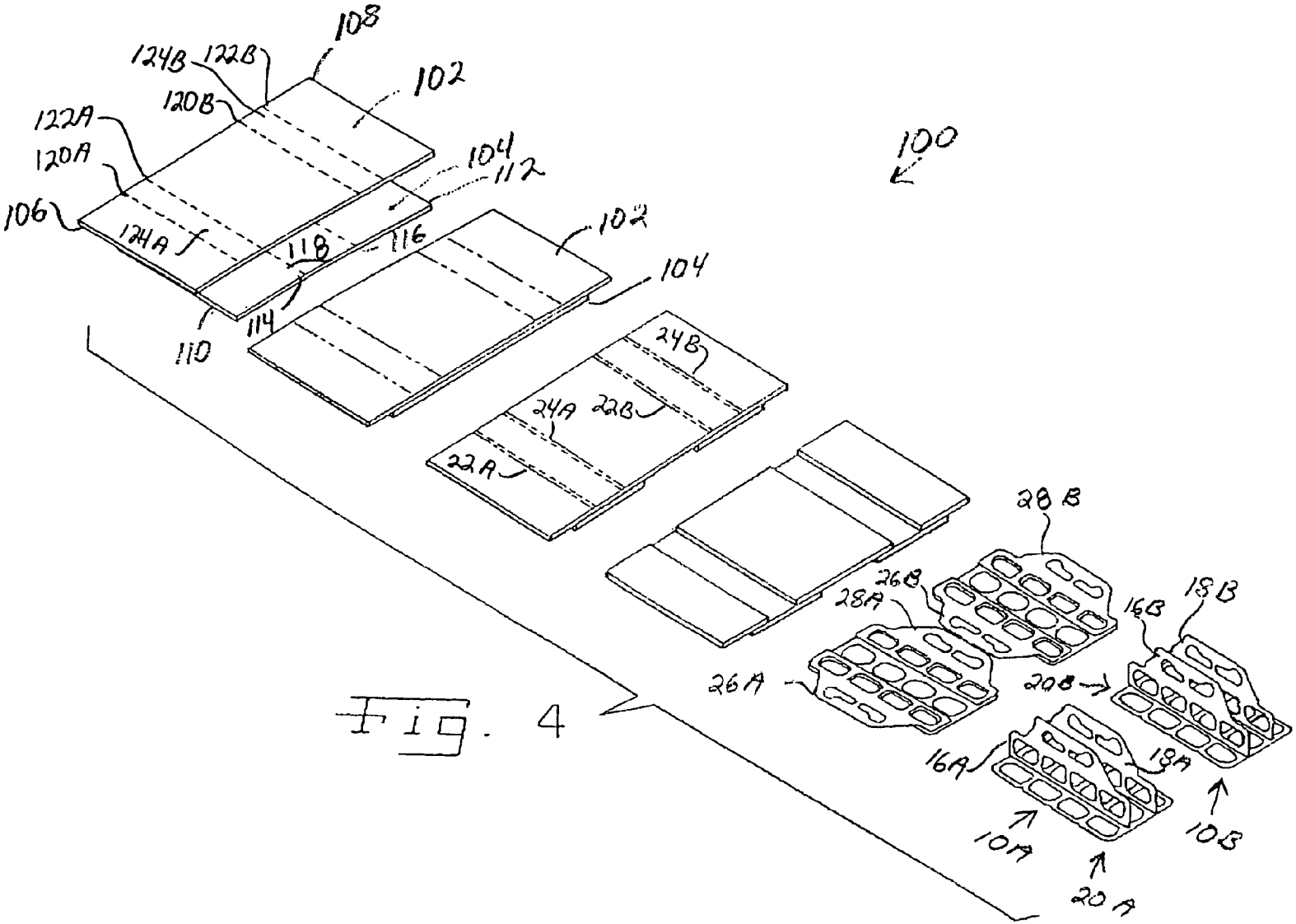
FIG. 4 is a progressive view of the manufacturing steps for making the carrier.

Steps in a method 100 of making carriers 10 are illustrated in FIG. 4. Method 100 includes providing a handle sheet 102 and a carrier sheet 104, of suitable materials, which can be the same or different from each other in composition or physical characteristics, such as thickness, for example. As illustrated, sheets 102 and 104 are of sufficient width so that two adjacent rows of carriers 10A and 10B are made. However, it should be understood that method 100 can be used to make only a single row of carriers 10 one behind another, or in a suitable arrangement could be used to make more than two rows of carriers side by side. In FIG. 4, corresponding elements of carriers 10A and 10B are designated with similar numerals but appropriate suffixes of "A" or "B". In the descriptions thereof to follow, references to various elements without the "A" or "B" suffixes should be understood to apply equally to carriers 10A and 10B.

For ease of illustration, the various steps in method 100 are shown performed on sheets 102 and 104 substantially the length of a single carrier 10. However, those skilled in the art will understand that sheets 102 and 104 commonly are provided as continuous webs from which carriers 10 are formed one after another. While shown separated from each other, successive carriers 10, one behind another, can stay connected for grouping and supply to suitable application equipment inserting containers 14 therein.

An advantage of the present invention is that carrier sheet 104 can be standard, substantially transparent, low-density polyethylene commonly used for carriers of the type, and handle sheet 102 can be provided as a different material, perhaps of heavier weight or thickness, or of a different color. Since handle portions 16 and 18 are formed in a sheet different from that of container holding portion 20, each can be optimized for its particular use.

Sheets 102 and 104 are provided as solid sheets, with handle sheet 102 having side edges 106 and 108 and carrier sheet 104 having side edges 110 and 112. Sheets 102 and 104 are positioned on each other in an overlying manner. In the configuration of carriers 10 shown in FIG. 4, handle sheet 102 is wider than carrier sheet 104, and margin portions of handle sheet 102 from which handles 26A and 28B are formed extend beyond carrier sheet edges 110 and 112. Connecting together sheets 102 and 104 is achieved by welding the sheets as described previously along welds 22A and 24A for carriers 10A and 22B and 24B for carriers 10B. Spaced perforation lines 114 and 116 are provided in carrier sheet 104 so that a central strip 118 thereof can be removed, separating container holding portions 20A and 20B, beneath a portion of handle sheet 102 from which handles 26B and 28A are formed.

Pairs of perforation lines 120A, 122A and 120B, 122B are provided in handle sheet 102 for enabling removing of strips 124A and 124B to respectively separate first handle portion 16A from second handle portion 18A and first handle portion 16B from second handle portion 18B. Welded sheets 102 and 104, preferably with strips 118, 124A and 124B previously removed, are processed through a punch press or die cutter, in known manner, for forming the configuration of carrier 10, including first and second handle portions 16 and 18, and rows of apertures 40, 50 and 60 in container holding portion 20. Material removed as strips 118, 124A and 124B, and during punching to create the open structure shown is readily recyclable.

Simultaneously with forming apertures defined by loops 42, 44, 46 and 48 in first row 40 (FIG. 3), a similarly configured row 140 of holes 142, 144, 146 and 148 (FIG. 2) is formed in first handle portion 16 as the cutting equipment shears through overlying sheets 102 and 104. Similarly, simultaneously with forming apertures defined by loops 62, 64, 66 and 68 in third row 60 (FIG. 3), a similarly configured row 160 of holes 162, 164, 166 and 168 (FIG. 2) is formed in second handle portion 18 as the cutting equipment shears through overlying sheets 102 and 104. With strip 124 having been removed, forming apertures defined by loops 52, 54, 56 and 58 in second row 50 is performed without impact on handle sheet 102.

Figure 3:
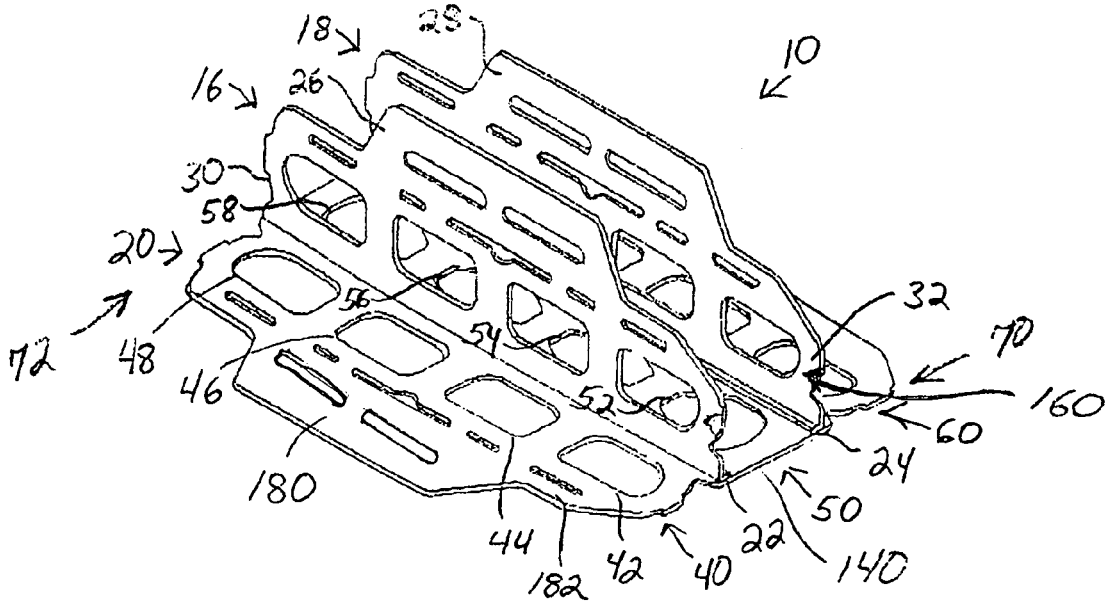
FIG. 3 is a perspective view of the carrier, with the handles thereof in elevated positions.

The present invention is capable of numerous variations and modifications, some of which are shown in the drawings. For example, FIG. 3 illustrates a merchandising panel 180 formed along a margin portion 182 of container holding portion 20, adjacent one or more of rows 40, 50 or 60. Merchandizing panels 180 are used as an area to display information, logos or other visually communicative formations. In forming merchandising panel 180, side edges of sheets 102 and 104 are aligned and/or central strip 118 is not removed, and merchandizing panel or panels 180 are formed simultaneously with and in the same shape as one or more of first and second handles 26 and 28. Panel 180 will then have the same configuration, including cutouts used in forming handles 26 and 28. Adhesive labels can be applied over any such cutouts in panel 180. Advantageously, a simple slit can be used to form handles 26 and 28, creating only a simple slit also in panel 180 that is not disruptive to the application of labels or printing on panel 180.

Figure 2:
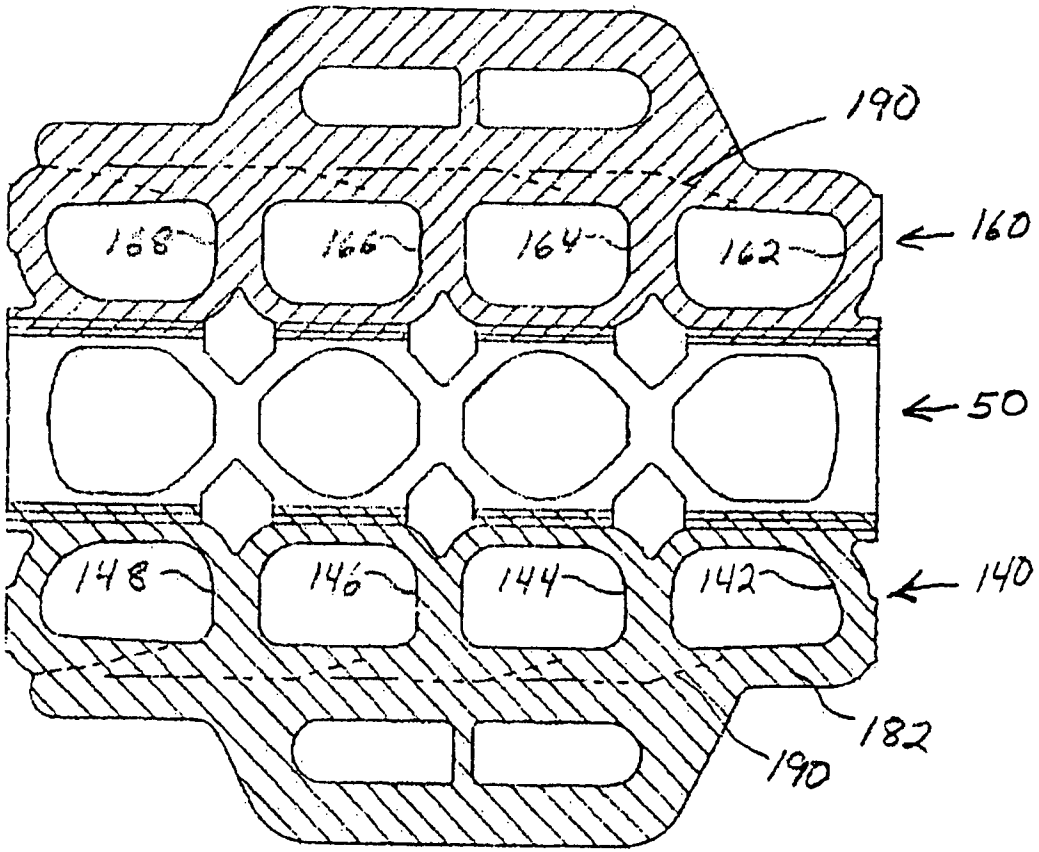
FIG. 2 is a plan view of the carrier used in the package of FIG. 1.
Figure 5:
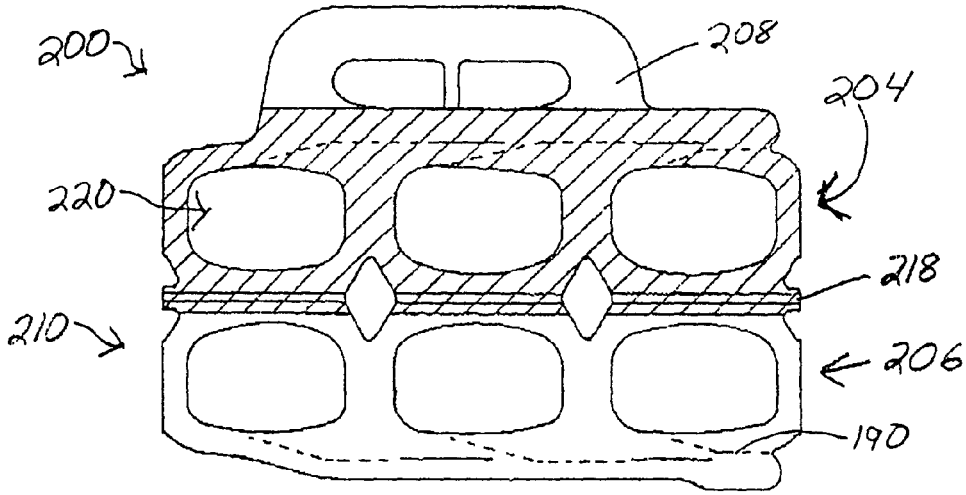
FIG. 5 is a plan view of a 6-pack carrier in accordance with the present invention.

FIGS. 2 and 5 illustrate perforations forming tear lines 190 in margin portion 182 by which apertures in rows 40, 50 or 60 can be ruptured for removing containers 14. If tear lines 190 are punched while handle portions 16 and 18 are against container holding portion 20, the location, spacing and size of the perforations are selected to ensure handle integrity during use. Alternatively, the perforations can be formed only in the container holding portion 20, with handle portions 16 and 18 moved out of the way during the process.

Figure 6:
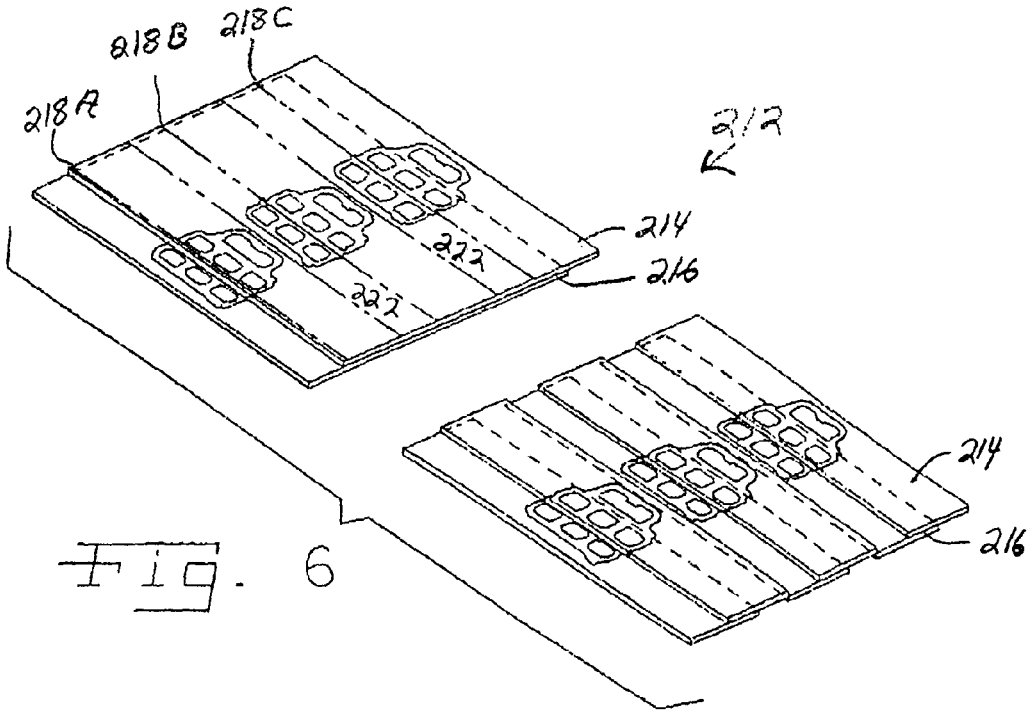
FIG. 6 depicts stages in the preparation of the sheets for carriers similar to that shown in FIG. 5.

FIG. 5 illustrates the present invention as a carrier 200 for a six-pack or other package having only first and second rows 204 and 206 defining apertures for receiving containers. A single handle portion 208 is provided connected to container holding portion 210. In a manufacturing method 212 for making three carriers 200A, 200B and 200C side by side from a handle sheet 214 and a carrier sheet 216, as shown in FIG. 6, single lines of weld 218 are provided in each carrier 200A, 200B and 200C. Holes 220 in handle portion 208 are formed simultaneously with and similarly configured to first row 204 in container holding portion 210. Strips 222 are removed from handle sheet 214, and/or handle sheet 214 is positioned such that no material of handle sheet 214 overlies portions of carrier sheet 216 in which apertures of second row 206 are formed.

The present invention provides a carrier with handles positioned between adjacent rows of containers in both three wide and two wide configurations. Known applicating equipment can be used for applying carriers in both two wide and three-wide configurations. Therefore the present carriers can be used without substantial modification or redesign of applicating equipment.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A method of making a container carrier, comprising steps of:

providing a handle sheet and a carrier sheet;

positioning the handle sheet on at least a portion of the carrier sheet;

connecting the handle sheet and the carrier sheet along a line of attachment;

forming a container holding portion only in the carrier sheet, including forming first and second rows of container receiving apertures in the carrier sheet on opposite sides of the line of attachment after said steps of positioning and connecting;

forming a handle portion only in the handle sheet, including forming holes in the handle sheet simultaneously with forming the first row of apertures; and said step of forming holes in the handle sheet and said forming the first row of container receiving apertures in the carrier sheet being performed by cutting through overlying portions of said handle sheet and said carrier sheet and thereby forming said holes of the handle sheet and said first row of container receiving apertures of the carrier sheet in overlying arrangement and in substantially the same configurations one over the other.

2. The method of claim 1, said step of connecting performed by creating a substantially continuous weld between said sheets.

3. The method of claim 2, including connecting the handle sheet with the carrier sheet along first and second spaced lines of attachment; and thereafter removing a portion of the handle sheet between the first and second spaced lines of attachment to define first and second handle sheet portions separate from each other.

4. The method of claim 3, including forming the first row of apertures between one of the lines of attachment and an edge of the carrier sheet, forming the second row of apertures between the lines of attachment; and forming a third row of apertures in the carrier sheet on an opposite side of the other of the lines of attachment from the second row of apertures.

5. The method of claim 4, including forming holes in the handle sheet simultaneously with forming the third row of apertures in overlying arrangement by cutting through overlying portions of said handle sheet and said carrier sheet.

6. The method of claim 5, including forming first and second handles in said handle sheet outwardly of the holes with respect to said first and second lines of attachment.

7. The method of claim 6, including forming a merchandising panel simultaneously with forming at least one of the first and second handles.

8. A method of making a container carrier, comprising steps of:

providing a handle sheet and a carrier sheet;

positioning the handle sheet against the carrier sheet;

connecting the handle sheet and the carrier sheet along spaced first and second lines of attachment;

removing a strip of the handle sheet between the lines of attachment, leaving a first handle portion of the handle sheet outwardly from the first line of attachment and a second handle portion of the handle sheet outwardly from the second line of attachment;

forming a first row of container receiving apertures in the carrier sheet outwardly from the first line of attachment and simultaneously forming holes in the first handle portion of the handle sheet similarly shaped to the first row of apertures, said step of forming holes in the first handle portion of the handle sheet and said forming the first row of container receiving apertures in the carrier sheet being performed by cutting through overlying portions of the carrier sheet and the handle sheet to form the holes in the first handle portion and the first row of apertures in overlying arrangement and of substantially the same configurations;

forming a second row of apertures in the carrier sheet between the first and second lines of attachment; and forming a third row of container receiving apertures in the carrier sheet outwardly from the second line of attachment and simultaneously forming holes in the second handle portion of the handle sheet similarly shaped to the third row of apertures, said step of forming holes in the second handle portion of the handle sheet and said forming the third row of container receiving apertures in the carrier sheet being performed by cutting through overlying portions of the carrier sheet and the handle sheet to form the holes in the second handle portion and the third row of apertures in overlying arrangement and of substantially the same configurations;

said forming steps being performed after said steps of positioning and connecting.

9. The method of claim 8, said forming steps performed by die cutting.

10. The method of claim 8, including providing the handle sheet wider than the carrier sheet, positioning the sheets with first and second margin portions of the handle sheet extending beyond the carrier sheet on opposite sides, and forming handles in the margin portions of the handle sheet outwardly of the carrier sheet.

11. The method of claim 10, said forming steps performed by die cutting.

12. The method of claim 8, including forming a handle in the handle sheet and simultaneously forming a merchandising panel in the carrier sheet configured substantially the same as the handle.

13. The method of claim 8, including providing the handle sheet of material different from the material of the carrier sheet.

* * * * *